United States Patent [19]

Harper, Jr.

[11] 4,362,527

[45] Dec. 7, 1982

[54] RADIATION-RESISTANT FLUOROAROMATIC CELLULOSIC ETHERS

[75] Inventor: Robert J. Harper, Jr., Metairie, La.

[73] Assignee: The United States of America as represented by the Secretary of Agriculture, Washington, D.C.

[21] Appl. No.: 337,045

[22] Filed: Jan. 4, 1982

[51] Int. Cl.[3] ..... D06M 13/08

[52] U.S. Cl. ..... 8/194; 8/120; 8/129

[58] Field of Search ..... 8/120, 129, 194

[56] References Cited

U.S. PATENT DOCUMENTS

| | | | |
|---|---|---|---|
| 2,990,234 | 6/1961 | Klein et al. | 8/120 |
| 2,992,881 | 7/1961 | Berni et al. | 8/120 |
| 3,079,214 | 2/1963 | Berni et al. | 8/120 |
| 3,147,064 | 9/1964 | Brown et al. | 8/120 |
| 3,322,490 | 5/1967 | Gagliardi | 8/194 |
| 3,443,879 | 5/1969 | Arthur et al. | 8/120 |
| 3,519,382 | 7/1970 | Arthur et al. | 8/120 |

OTHER PUBLICATIONS

Journal of Applied Polymer Science 11, 1129–1138, (1967), Jett C. Arthur, Jr., David Stanonis, Trinidad Mares and Oscar Hinojosa.

*Primary Examiner*—Maria Parrish Tungol
*Attorney, Agent, or Firm*—M. Howard Silverstein; David G. McConnell; Raymond C. Von Bodungen

[57] ABSTRACT

A process for improving the radiation resistance of cellulosic fabrics is disclosed. Fabric is immersed first in a 23% caustic solution for 15 minutes and then in a 5% caustic solution for 15 minutes. The excess caustic is removed and the fabric padded to 105% wet-pickup using neutralized pentafluorobenzoic acid. The fabric is then cured at 130°–140° C. for 6–8 minutes.

9 Claims, No Drawings

RADIATION-RESISTANT FLUOROAROMATIC CELLULOSIC ETHERS

BACKGROUND OF THE INVENTION (1) Field of the Invention

This invention relates to a process for improving the radiation resistance of cellulosic fabrics.

(2) Description of the Prior Art

Phenyl esters and benzyl type ethers of cellulose have been used to improve the radiation resistance of cellulosic fabrics. The phenyl esters are prepared by reaction of sodium cellulose with

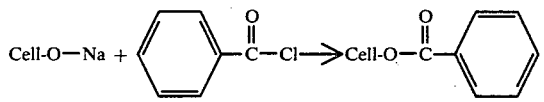

acid chloride to form the corresponding cellulose benzoates. The other reaction that is commonly employed involves the reaction of benzyl chlorides with sodium cellulose to form benzyl ethers of cellulose. The resultant fabrics show

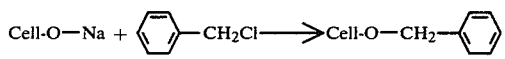

improved strength retention when exposed to radiation. Other compounds have been used to achieve the same effect but the reaction involves either the use of an acid chloride as in the case of cinnamyl chloride or naphthoyl chloride

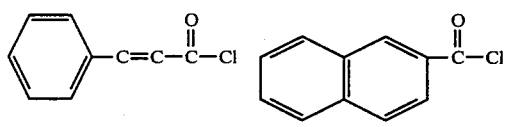

cinnamyl chloride naphthoyl chloride or more complex benzyl type chlorides such as benzhydryl or trityl chlorides.

The use of these agents for reaction with cellulose to produce radiation resistant cellulose poses several difficulties. First, acid chlorides and benzyl chlorides are lachrymatory and handling them requires closed systems. Second, they are not water soluble, so reactions are heterogeneous and large excesses of reagents are required. Third, in order to achieve the high degree of substitution required with these reagents reaction times of up to 6 hours or more are required.

Although benzoylation can be speeded up by the use of pyridine as the solvent, as described in U.S. Pat. No. 3,519,382; there is still the limitation of handling an acid chloride in a malodorous solvent.

Finally, some comment should be made relative to the high degree of substitution (DS) required of the agents described in the prior art. While DS varying from 0.3 to 1.5 are reported it is apparent that a DS of 0.5 is required [J. of Applied Polymer Science 11, 1129–1138 (1967)] to achieve maximum strength retention after irradiation.

SUMMARY OF THE INVENTION

We have discovered a process for preparing a series of fluoroaromatic ethers of cotton. Further, we have discovered that these fluoroaromatic ethers confer radiation resistance to cotton. This invention is based upon nucleophilic substitution of an aromatic fluorine by a cellulose alkoxide anion:

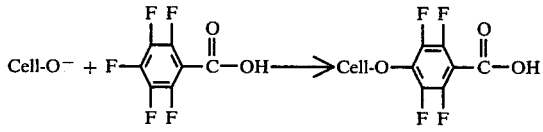

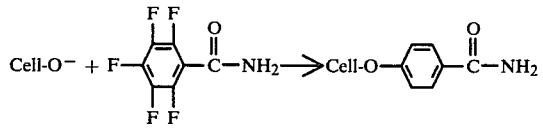

The process comprises: immersing a fabric in a caustic solution; removing the excess solution from the fabric; padding the fabric using a neutralized aqueous bath of pentafluorobenzoic acid; and curing the fabric.

Further modification of the fluoroaromatic cellulose ether can be achieved by decarboxylation reaction in dimethylsulfoxide.

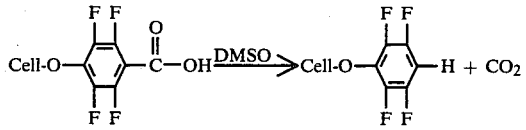

Fabrics containing the fluoroaromatic groups were found to have improved radiation resistance over untreated and mercerized cotton.

This invention provides the improvement that under basic conditions, pentafluoro benzoic acid is water soluble and non-volatile. As such, reaction with cotton can take place in an aqueous medium, eliminating exposure to acid chlorides, benzyl chlorides or foul smelling solvents.

The second advantage of this process is that it does not employ a lachrymator. Fluorine in a fluoroaromatic group can be replaced by nucleophilic attack but the aromatic fluorine is not subject to hydrolysis, like acid chlorides or benzyl chlorides, which tend to generate hydrogen chloride in air and to act as lachrymators. Finally, it should be noted that this reaction produces cellulose phenyl ethers, whereas previous work produced phenyl esters or benzyl ethers, in which the cellulose oxygen is not directly attached to the phenyl group.

One further advantage in this system is that improved radiation resistance is achieved with a significantly lower degree of substitution than observed in previously reported systems.

DESCRIPTION OF THE PREFERRED EMBODIMENTS

The preferred procedure for producing carboxyfluoroaromatic cellulose (CFC) consists of immersing fabric first for 15 min in 23% caustic, then 15 min in 5% caustic, squeezing, and then padding to approximately 105% total wet pick-up using an aqueous bath containing 17–20% pentafluorobenzoic acid (neutralized with base to pH 8). The fabric was then cured for 6–8 min at 130°–140° C. In some cases, the reaction sequence starting with immersion in 5% caustic was repeated on a given fabric sample for one or two times. These samples were designated as reacted twice and reacted thrice, respectively. In an alternate procedure, the bath containing pentafluorobenzoic was neutralized, then conc. caustic was added so that overall bath contained 5% caustic concentration. Printcloth was padded with this formulation to 105% wet pick-up, then cured for 8–10 min at 120°–135° C.

The carboxytetrafluorophenyl cellulose was decarboxylated by taking the CFC fabric and refluxing same for one hour in dimethyl sulfoxide.

For reaction with non-water soluble fluoroaromatics such as pentafluorobenzamide a modified process was effective.

In the case in which fabric was reacted with pentafluorobenzamide, the initial treatments with 23% and 5% caustic following by squeezing were the same as in the usual procedure with pentafluorobenzoic acid. However, in the amide treatment, the fabric was immersed in a dimethylformamide (DMF) solution containing 11% pentafluorobenzamide. The solution was refluxed for two hours. Sample was then washed with water, extracted with acetone and rewashed in water to yield what will be known as CFC amide fabric.

Representative fabrics prepared in the manner described above were exposed to 25 megarads radiation using a Cobalt 60 source. A description of the fabrics so tested and their breaking strength before and after radiation are given in accompanying Table I.

TABLE I

RESISTANCE OF FABRICS TO 25 MEGARADS RADIATION

| Sample | % F | DS | Fill Breaking Strength, lbs Before Radiation | After Radiation | % Retained |
|---|---|---|---|---|---|
| CFC Fabric, 1.9% COOH | 3.8 | .09 | 35.3 | 28.2 | 79.9 |
| CFC Fabric, 1.0% COOH | 1.5 | .03 | 37.0 | 23.3 | 63.0 |
| CFC Fabric, 0.7% COOH[a] | 1.0 | .02 | 33.7 | 20.0 | 59.4 |
| CFC Amide Fabric, 13.5% Add-on | 3.3 | .07 | 25.6 | 21.2 | 82.3 |
| Untreated Cotton | 0 | .00 | 39.3 | 13.4 | 34.0 |
| Mercerized Cotton | 0 | .00 | 52.3 | 14.2 | 27.1 |

[a]Fabric decarboxylated in DMSO prior to radiation

EXAMPLE 1

A 15 gram sample of cotton print cloth was soaked in a solution of 23% sodium hydroxide for 15 minutes, removed and soaked in a solution of 3% sodium hydroxide for 15 minutes, then squeezed, then padded through a 17% solution of pentafluorobenzoic acid (neutralized to pH 8), and squeezed again. Wet pick-up after padding with pentafluorobenzoic acid solution was 105%. The fabric was then cured for 8 minutes at 140° C. The fabric was then rinsed in water, soured in dilute hydrochloric acid (2%), rewashed, and line dried. There was obtained a fabric with 10.8% add-on, 1.01% carboxyl content. When subjected to 25 megarads radiation, a sample of this fabric retained 63% of fill breaking strength compared to 27% for an untreated cotton control.

EXAMPLE 2

A 12.6 g sample of cotton print cloth was soaked in 23% caustic for 30 min, removed and placed in 5% caustic for 15 minutes, removed, squeezed in a padroll and placed in a solution containing 20% pentafluorobenzic acid (neutralized to pH 8 with NaOH) squeezed again and cured for 8 minutes at 130° C. The sample was rinsed, soured with dilute hydrochloric acid, washed and line dried. The resultant fabric had an add-on of 7.1%, a carboxyl content of 0.96%, a fluorine content of 1.54% and 261° wet WRA (W+F).

EXAMPLE 3

A 14 g sample of cotton print cloth was treated in the same way as in Example 2. After the curing step, the fabric was soaked in a 5% caustic for 15 minutes, squeezed in a pad roll, placed in a solution containing 20% pentafluorobenzoic acid (neutralized to pH 8 with NaOH) squeezed again and cured for 8 min at 130° C. This same procedure starting with soaking in 5% caustic was repeated again. The fabric was then rinsed, soured in dilute hydrochloric acid, washed and line dried. The resultant fabric had a carboxyl content of 1.9%, a fluorine content of 3.8%, a wet wrinkle recovery of 282° and retained 79.9% of fill breaking strength after exposure to 25 megarads radiation from a Cobalt-60 source.

EXAMPLE 4

A 14 gram sample of mercerized cotton print cloth was padded with a solution containing neutralized pentafluorobenzoic acid and added caustic. This bath was prepared by suspending 21 g of pentafluorobenzoic acid in 120 g water, neutralized to pH 8 with NaOH, then adding 8.5 g of caustic (NaOH) and water, so that total aqueous solution contained 170 g, 5% of which was caustic. The fabric was then cured for 8 minutes at 130° C., rinsed, soured and washed. The resultant fabric had 0.8% carboxyl content, 1.6% fluorine and 10.3% add-on.

EXAMPLE 5

A 5.4 g sample of cotton print cloth was placed in 23% caustic for 15 minutes. It was removed and placed in 5% caustic for 15 minutes. The sample was then squeezed and placed in a flask containing 17 g of pentafluorobenzamide and 83 g of dimethyl formamide. The mixture was refluxed for 2 hours. Then, the formamide solution was decanted, sample was rinsed extensively in water, extracted with acetone and rinsed again in water. The sample was then dried. The resultant fabric had 24% add-on and a fluorine content of 5.9%. A similar procedure using a solution containing 11 grams pentafluorobenzamide and 89 grams of dimethyl formamide yielded a fabric with 13.5% add-on. This fabric on exposure to 25 megarads radiation retained 82.3% fill breaking strength.

EXAMPLE 6

A sample of CFC fabric with a carboxyl content of 1.9% was refluxed for 1 hr in dimethyl sulfoxide. The sample was washed and dried. Analysis showed that carboxyl content was reduced to 0.19%. Another sample of CFC fabric with a carboxyl content of 1.01% was similarly treated in dimethyl sulfoxide. The carboxyl content was reduced to 0.35%. Examination of the infrared spectra of these samples showed a substantial reduction in carboxyl content, and other changes consistent with decarboxylation having taken place. An example of fabric so treated (1.0% Fluorine content) retained 59.4% fill breaking strength after being exposed to 25 megarads radiation.

I claim:

1. A process to improve the radiation resistance of cellulose fabrics comprising:

(a) immersing a fabric in a caustic solution;

(b) removing the excess solution from the fabric;

(c) padding said fabric using a neutralized aqueous bath of pentafluorobenzoic acid;

(d) curing said fabric.

2. The process of claim 1 including refluxing the cured fabric in dimethylsulfoxide for 1 hour, and then washing and drying the fabric.

3. The process of claim 1 including the following steps after step (b):

(a) refluxing the cured fabric in a solution containing 17 g of pentafluorobenzamide and 83 g of dimethyl formamide for 2 hours;

(b) rinsing the fabric in water;

(c) extracting the fabric with acetone;

(d) rinsing the fabric with water;

(e) drying the fabric.

4. The process of claim 1 wherein the fabric is immersed in a 23% caustic solution for 15 minutes and then in a 5% caustic solution of 15 minutes.

5. The process of claim 1 wherein the padding is to 105% of wet-pickup using an aqueous bath containing about 17–20% pentafluorobenzoic acid (neutralized with a base to pH 8).

6. The process of claim 1 wherein the fabric is cured at about 130°–140° C. for about 6–8 minutes.

7. The product of the process of claim 1.

8. The product of the process of claim 2.

9. The product of the process of claim 3.

* * * * *